United States Patent [19]

Rickard

[11] 3,942,576

[45] Mar. 9, 1976

[54] WINDOW GUARD

[76] Inventor: James E. Rickard, 7324 Atoll St., North Hollywood, Calif. 91605

[22] Filed: Feb. 24, 1972

[21] Appl. No.: 228,931

[52] U.S. Cl. ..... 160/104; 160/225; 160/323 R; 49/55

[51] Int. Cl.[2] ..... A47H 1/00; E06B 3/00

[58] Field of Search ..... 160/222–225, 160/104; 49/50, 55, 57

[56] References Cited

UNITED STATES PATENTS

| | | | |
|---|---|---|---|
| 446,480 | 2/1891 | Stebbins | 49/55 |
| 1,579,445 | 4/1926 | Haddox | 49/55 |
| 1,662,167 | 3/1928 | Rexinger | 160/225 |
| 3,203,468 | 8/1965 | Gossling et al. | 160/323 R |

*Primary Examiner*—Paul R. Gilliam
*Assistant Examiner*—Victor N. Sakran
*Attorney, Agent, or Firm*—Georges A. Maxwell

[57] ABSTRACT

A window guard for double-hung sash and window which is laterally and vertically adjustable to adjust to windows of different dimensions and which is cooperatively proportioned and related with a related window structure whereby the inner lower sash and the upper outer sash of the window structure are shiftably to afford ventilation through the upper and lower portion of the window structure and which prevents ingress and egress of unauthorized persons through the window structure. A guard structure of the character referred to having novel anchoring means and novel locking means to secure the guard in a related window structure.

2 Claims, 13 Drawing Figures

Fig. 1.
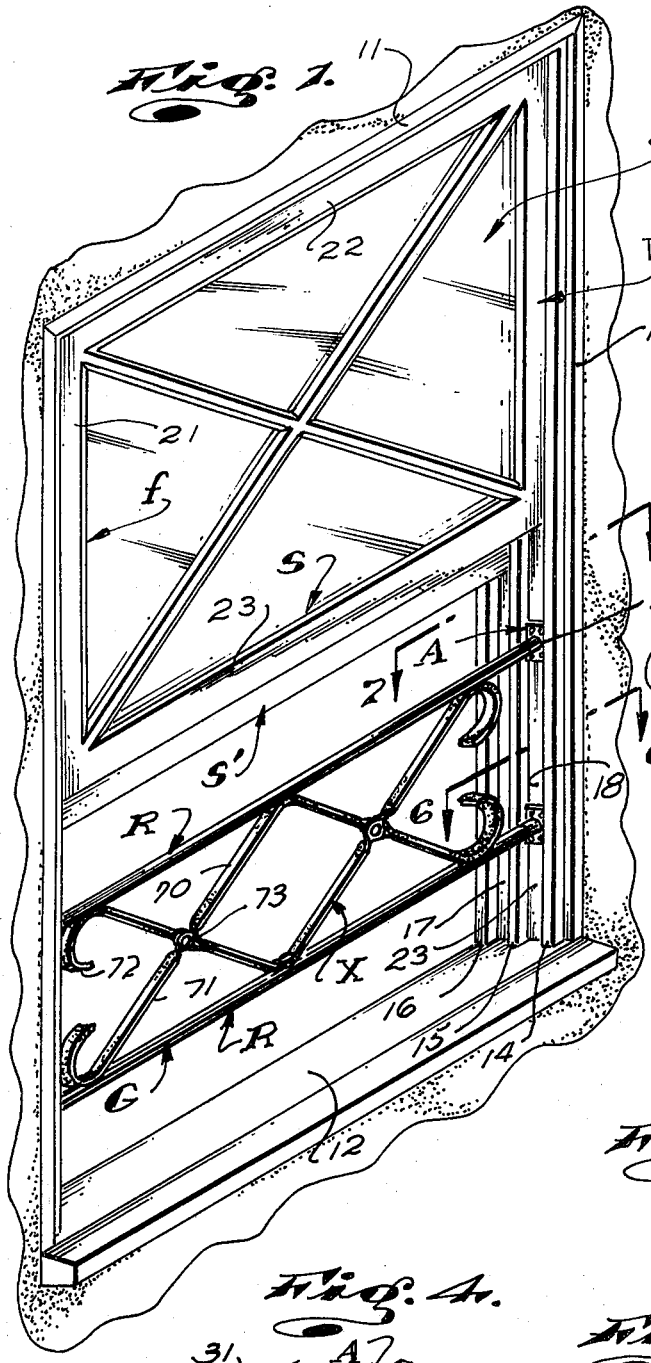
Fig. 2.
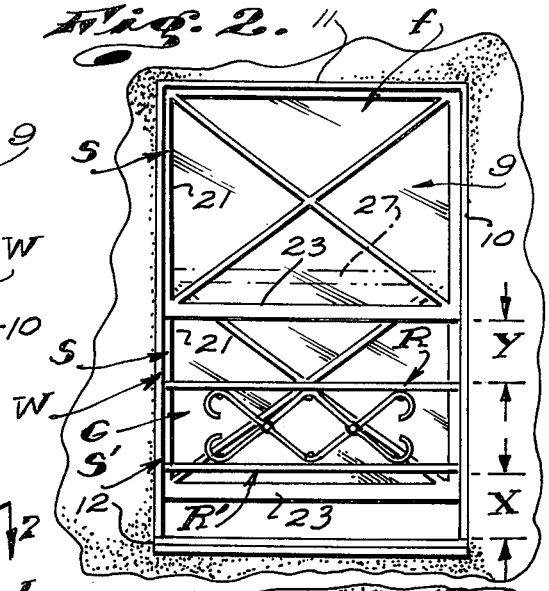
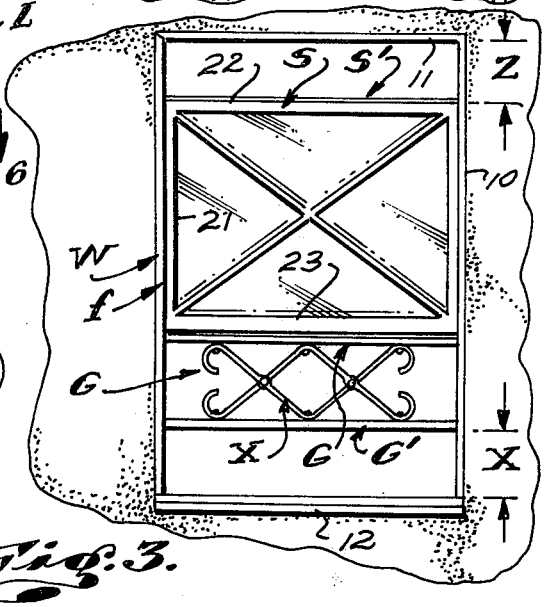
Fig. 3.
Fig. 4.
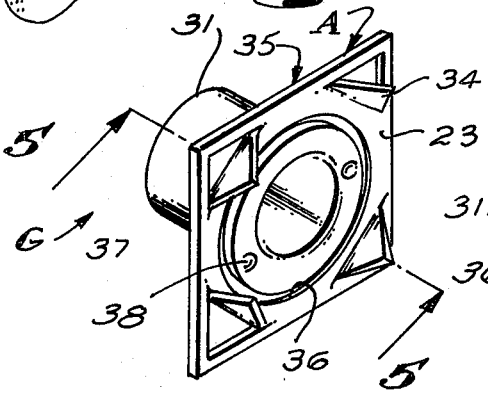
Fig. 5.
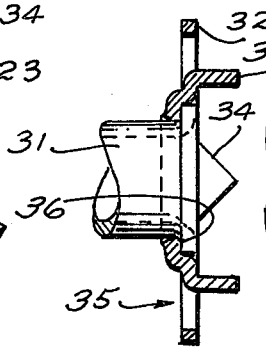
Fig. 6.
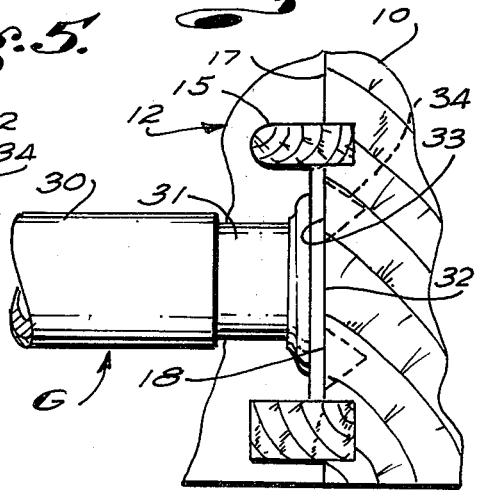

WINDOW GUARD

This invention has to do with a window guard and is more particularly concerned with an improved guard for use in connection with double-hung sash and window structures.

The desirability and the need for guard means to prevent the ingress and egress of unauthorized persons through double-hung sash and windows in both residential and commercial building structures and thereby prevent the burglarizing of such premises and/or physical attack upon persons within such peremises has long been recognized. Further, the desirability and need for guard means to prevent persons within buildings from falling through and out of such windows, with resulting physical harm, has also been long recognized.

The ordinary double-hung window structure includes a rectangular frame built into the related wall structure. The frame is charactertized by opposing inner and outer vertically extending channels or ways at its opposite sides and in which inner and outer window sash are slidably engaged. The inner and outer window sash are rectangular frame-like structures in which window glass panes are suitably fixed or glazed and are substantially equal in lateral extent and slightly greater than one-half the vertical extent of the window frame.

When the window structure is closed, the outer sash is moved to the uppermost position in its ways and in the frame, to close the top half of the frame and the inner sash is moved to its lowermost position in its ways and in the frame to close the bottom half of the frame. The outer sash in such structure is manually moved upwardly and closes the upper half of the window frames so that its lower, downwardly disposed edge occurs outward of the upper edge of the inner sash thereby providing a degree of weather protection which is such that rain water and the like is shed or directed away from the space between the sash.

When it is desired to open the window for ventilation, the outer sash can be slid down to any desired extent to effect opening of the upper half of the frame or a portion thereof; the inner sash can be slid up to any desired extent to effect opening of the lower half of the frame, or, the two sashes can be moved or slid to a limited extent, as above set forth and so that the uppermost and lowermost portions of the window frame are open.

It is this last noted shifting of the sash and opening of the window frame which is most desirable and which affords that special, desirable and unique ventilation for which double-hung sash and window structures are known and which has led to the wide use and acceptance.

In practice, the most widely adapted positioning of double-hung sash and windows to gain that effective ventilation for which such structures are designed is the lowering of the outer, upper sash a limited distance, for example, 4 to 6 inches, so as to allow for the free flow and escape of the upper, heated air in the room and the lifting or raising of the inner, lower sash a distance at least equal to and more frequently a distance substantially greater than the distance or extent to which the upper outer sash is lowered and so as to assure an adequate and free flow of fresh air in through the window.

If a burglar, attacker or other unauthorized person wishes to enter a building through such a window, it is a simple matter to physically raise the two sashes to their uppermost limits and enter through the opening therebelow, or, if necessary, the two sashes can be moved to their lowermost positions in the frame making it possible for the person to climb or step over the sash and enter the opening defined in the upper half of the frame.

While most window and sash structures of the character here referred to are provided with latches which lock the window sashes in their closed position, that is, in that position where the outer sash is fully up and the inner sash if fully down, such latches are notoriously weak, easily broken and practically ineffective. Further, when the sashes are positioned so as to render the latches operable, the windows are closed and no ventilation is possible.

The prior art has provided many different means intended to satisfy the above noted need to prevent undesired entry and/or exit of persons and objects through double-hung window structures. The most basic of such means has included iron gratings or grilles fixed to the exterior of a wall and overlying the entire frame opening. Such means are costly and are in most instances aesthetically unacceptable.

The most widely acceptable form of guard provided by the prior art has consisted of a metal grating or grille work approximately one-half the vertical extent of the opening of the frame, equal in lateral extent with the frame and engaged within the frame to occur in a common plane with and below the upper outer sash. Such guards occur between and engage the bottom edges of the upper outer sash and the lower edge or sill of the window frame, or occur in such close proximity thereto as to render the upper outer sash inoperative. Accordingly, such guards make it impossible to lower the upper outer sash so as to allow for ventilation through the upper portion of the window structure with which they are related.

The guards, last and above referred to, are such that they must be especially or custom built to fit in the window structures with which they are to be related and are rather costly to make and difficult to install.

An object of my invention is to provide a novel window guard of the general character referred to above which guard is engageable with a related window frame below an upper outer sash in the frame and which is such that it provides and/or allows for adequate lowering of the upper outer sash to establish ventilation through the upper portion of the window opening.

It is an object of my invention to provide a windown guard of the character referred to which is of minimum vertical extent so as to create the least possible obstruction to view through the window and the least possible undesirable aesthetic interference.

An object and feature of my invention is to provide a novel combination and relationship of window frame, window sash and guard wherein effective guarding of the window opening and effective operation of the window to gain normal and desired ventilation is achieved by special and unique proportioning and spacing of parts.

It has been determined that a person cannot readily pass through a vertical opening in a double-hung window which is less than 8 inches. Accordingly, a guard which is of sufficient vertical extent so that it defines a space of 8 inches between its lower edge and a window sill, a space of 8 inches between its upper edge and the lower edge of the upper outer sash, when said sash is in its uppermost position and a space of about 8 inches between the upper edge of the upper outer sash and the top of the window frame when the upper outer sash is moved down and stopped against the guard, effectively guards the window against a person's entry or exit therethrough.

It is an object of my invention to provide novel guard means including a guard structure engageable in a window frame below the upper outer sash therein which normally establishes predetermined spaced relationship with the lower edge of the sash and sill of the frame.

The lateral and vertical inside dimensions of double-hung window frames have, to an extent, become standardized, but such standardization has been based more upon the aesthetic proportioning of the windows and the relative proportioning of such windows to or with other standardi ed dimensions in building, such as the vertical extent of interior walls and the spacing of the upper and lower edges of window openings from their related ceilings and floors within a room.

As a result of the above, the true inside dimensions of a so-called standard 40 × 60 inch window may be plus or minus 1 inch, and still be considered to be within allowable tolerances. As a result of such allowable tolerances in the dimensions of window structures, a guard structure for engagement within the frames thereof must be provided with means to allow for lateral and/or vertical adjustment.

An object and feature of my invention is to provide a window guard structure having novel means to permit for lateral and/or vertical adjustment of the guard and so that it can be effectively adjusted to compensate for anticipated dimensional variations in the window structure with which it is related.

It is an object and feature of this invention to provide novel anchoring and locking means for securing my new guard in and with a related window frame and which is such that the guard cannot be easily or readily released or removed from engagement in and with the related window frame by persons who would seek to gain rapid, quiet and undetected access therethrough.

The foregoing and other objects and features of my invention will be fully understood from the following detailed description of typical preferred forms and applications of my invention, throughout which description reference is made to the accompanying drawings, in which:

FIG. 1 is an isometric view of a double-hung window structure with a window guard embodying my invention related thereto;

FIG. 2 is a front view of the structure shown in FIG. 1 showing parts in a different position;

FIG. 3 is a view similar to FIG. 2 showing parts in yet another position;

FIG. 4 is an isometric view of a part of my new guard structure;

FIG. 5 is a view taken substantially as indicated by line 5—5 in FIG. 4;

FIG. 6 is a view taken substantially as indicated by line 6—6 in FIG. 1;

Figure 7:
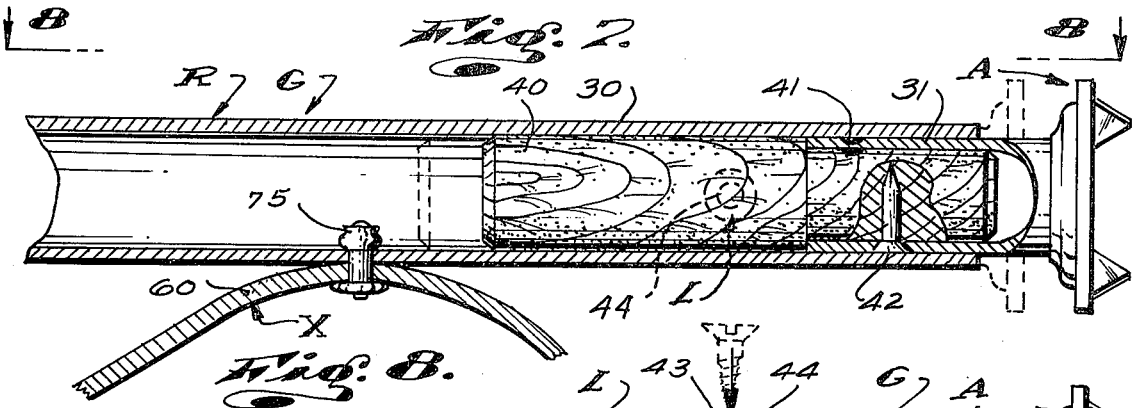
FIG. 7 is a view taken substantially as indicated by line 7—7 in FIG. 1.

In FIG. 1 I have shown a typical double-hung window structure W which includes a rectangular frame F suitably secured or built into a wall structure V and a pair of window sashes, there being an upper outer sash S and a lower sash S′.

The frame F is a rectangular structure established of wood and is characterized by a pair of laterally spaced vertical side members 10, a horizontal top member or header 11 and lower horizontal sill 12.

The members 10, header 11 and sill 12 define substantially flat surfaces disposed inwardly into the opening defined by the frame and the members 10 are provided with laterally spaced longitudinally extending outer, intermediate and inner ribs 14, 15 and 16 defining inner and outer vertical channels 17 and 18 to slidably receive the vertical side edges of the sashes S and S′ related thereto.

In practice, the header is provided with similar ribs defining similar channels to receive the upper edges of the sashes.

The inner and outer sashes S and S′ are substantially alike. Each sash includes a rectangular frame having vertical side members 21, the outer edges of which are slidably engaged in their related channels 17 and 18, upper, horizontal headers 22 defining the top edges of the sashes and lower horizontal sash members 23 defining the bottom edges of the sashes.

The sash S and S′ further include glass panes *g* suitably glazed and/or mounted within the sash frames *f.*

The sashes S and S′ are approximately one-half the vertical extent of the opening defined by the frame F and when in their normal position, the upper outer sash S occurs in and closes the upper half of the frame opening with its bottom edge spaced above the sill 12 and its top edge stopped on the frame header and the inner lower sash S′ occurs in and closes the lower half of the frame opening with its top edge spaced below the frame header and its lower edge stopped on the sill 12. The sashes are of sufficient vertical extent so that their adjacent related upper and lower edge portions occur in overlapping relationship with each other.

The outer sash is shiftable downwardly to open the upper portion of the frame opening to afford desired ventilation through the top of the opening and the inner sash is shiftable upwardly to afford desired ventilation through the lower portion of the opening.

As shown in FIG. 1 of the drawings, the lower sash can be shifted to the top of the frame F to fully open the lower half of the opening or, as shown in FIG. 2 of the drawings, it can be shifted upwardly a limited distance to partially open the lowermost portion of the lower half of the window opening and thereby afford limited ventilation therethrough.

Referring to FIG. 3 of the drawings, most effective and desirable ventilation through the window is gained by lowering the outer sash and raising the inner sash, to registering position in the window opening and so that about one quarter to one-third of the maximum possible opening of the window frame opening occurs at the uppermost portion of that opening and from about two-thirds to three-quarters of the maximum possible opening of the frame opening occurs at the lowermost portion of the window opening. Opening of the upper portion of the window to a lesser extent than the lower portion thereof as set forth above normally affords superior ventilation as a result of the differentials in temperature and resulting differentials in the density of the heated air in the room to be ventilated. Since the above and the physical laws which are involved are well known to those skilled in the art, further consideration thereof need not be entered.

The foregoing is or relates to that which is old, well established and which is well known in the art.

It will be apparent that if the window structure illustrated was 4 feet in vertical extent, the opening established in the lower half of the window in FIG. 1 of the drawings would be about 2 feet in vertical extent and if left unguarded, is such that an unauthorized person could move freely through the window structure.

If the inner lower sash was only partially raised or was in its down or closed position and not suitably locked, an intruder could easily move the inner sash to the position shown in FIG. 1 of the drawings.

It will be further apparent that if the lower inner sash S′ was down and locked, independently from the upper outer sash S, the outer sash could be easily shifted down, opening the entire upper 2 feet of the window opening and find free access into and out of the building in which the window structure is arranged by climbing or stepping over the two lowered sashes.

The present invention involves a novel guard structure G for the window structures W described above and a novel combination and relationship of that guard structure with the window structure.

The guard structure G includes a pair of elongate vertically spaced horizontal top and bottom rods R and R′ and a grate structure X between and carried by the rods, The rods R and R′ are alike and each is axially extensible, being made up of telescopically engaged tube sections and having novel window frame engaging anchoring means A at its opposite ends and releasable locking means L to secure the sections in fixed relative axial positions.

In the case illustrated, the rods R and R′ are made up of a primary outer tube section 30 and one or two secondary inside or inner tube sections 31 slidably engaged in one or both ends of the primary outer sections and projecting axially outwardly therefrom.

The provision of one or two sections 31, providing one such section at one end of the section 30 or providing one such section at each end of the section 30 is optional and is determined by the extent of axial extensibility that is desired.

For the purpose of this disclosure, I will, in the following, describe the rods R and R′ as having but one section 31 at one end of the rods. The rod sections 30 and 31 can be of any desired cross-section. In the form of the invention shown in FIGS. 1 through 9 of the drawings, the rod sections 30 and 31 are round in cross-section while in the form of the invention shown in FIGS. 10 through 13, the rod sections 30′ and 31′ are established of square tube stock.

Further, and as shown in FIGS. 10 through 13, the primary section 30′ can be smaller in cross-section than the section 31′ and can be slidably engaged in the section 31′.

The anchoring means A that I provide includes flat axially outwardly disposed stop surfaces 32 at the free ends of the rod sections to engage and stop against the opposing inwardly disposed bottoms 33 of the outer window frame channels 18 with which the rods are to be related and a plurality of axially outwardly projecting, pointed window frame piercing spikes 34.

In practice, and as shown in FIGS. 4 through 8 of the drawings, the surface 32 is established by a square or rectangular plate 35 with a central apertured cup 36 in which the end of its related rod section is slidably engaged, flared and spot welded as at 37 and 38 for securing the plate and section together. The spikes 34 are established in the plate by piercing and forming the plate as clearly shown in FIGS. 4 and 5 of the drawings.

The plate is preferably substantially equal in lateral extent with the channel 18 in which it is engaged and so that it is held in the channel against rotation and against inward and outward shifting in and relative to the window opening when engaged in the channel. Such a relationship also inhibits the engatement of a tool or the like with the plate in a manner that would permit forcing the plate from engagement in and with the window frame (See FIG. 6 of the drawings).

When the surface 22 is moved into engagement with the bottom 33 of the channel 18, the spikes 34 are urged and bite into the wooden vertical frame member 10 defining the channel to secure the rod sections against movement in any direction on the plane of the channel bottom 33.

Figure 10:
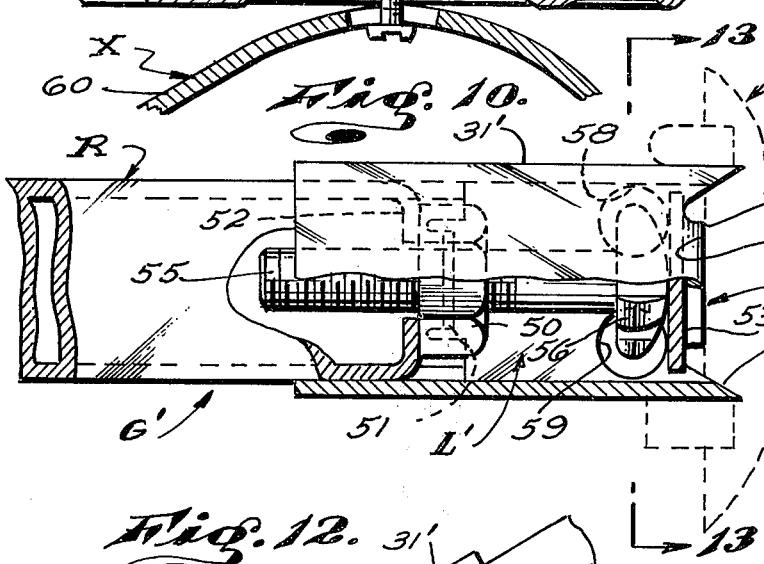
FIG. 10 is a view similar to FIG. 8, showing another form of my invention.
Figure 11:
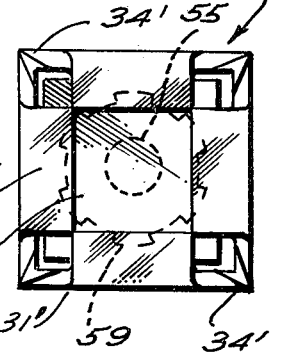
FIG. 11 is a view taken as indicated by line 11—11 in FIG. 10.
Figure 12:
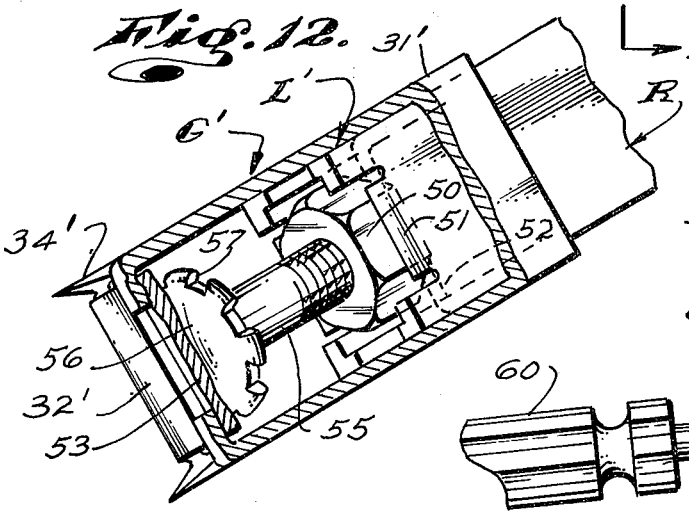
FIG. 12 is an isometric view of the structure shown in FIGS. 10 and 11.
Figure 13:
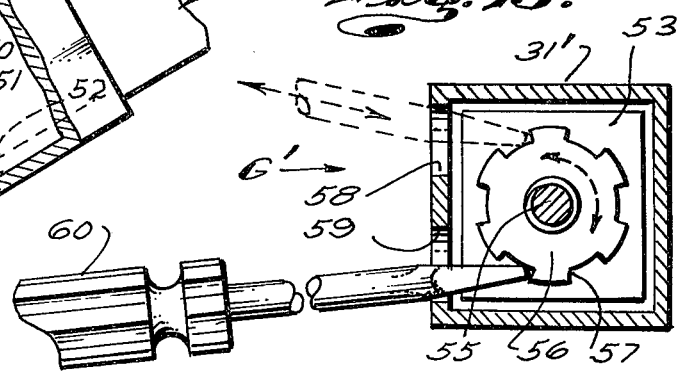
FIG. 13 is a view taken as indicated by line 13—13 in FIG. 10 and showing an operating tool related to the construction.

In another form and carrying out of my invention, as is shown in FIGS. 10, 11 and 12 of the drawings, the stop surfaces 32′ and spikes 34′ can be established integrally on and with the ends of their related sections 30′ and 31′. In the case shown, the corners at the free ends of the rod sections are cut diagonally and inwardly to define sharp spikes 34′ and the stock between the spikes is bent inwardly to define the stop surfaces 32′ as clearly illustrated in the drawings.

The rods of the guard that I provide, in whichever form they might take, are arranged horizontally in the window opening, in the desired vertical plane and at desired vertical locations within the window opening whereupon they are telescopically extended and urged so that the stop surfaces 32 (or 32′) are stopped against the bottoms of the channels 18 and so that the spikes 34 (or 34′) bite into and are engaged in the frame structure.

Figure 8:
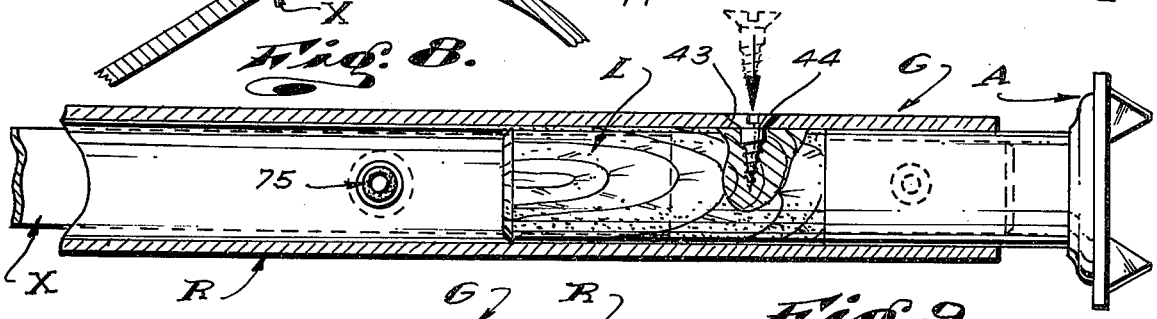
FIG. 8 is a view taken as indicated by line 8—8 in FIG. 7.

The locking means L, as shown in FIGS. 7 and 8, and the means L′ as shown in FIGS. 10 through 13 serve to lock the sections of the rods in their above noted seated and anchored engagement in their related window openings.

The means L includes an elongate wooden dowel 40 carried by the inner section 31 of each rod and projecting axially inwardly threfrom into the section 30, in sliding engagement therewith. The outer end of the dowel can, as shown, be press fitted into the section 31 and secured therein by means of a suitable cement; by crimping the section 31 as indicated at 41 and/or by pinning the dowel and section 31 together, as by means of a nail 42 or the like.

The means L next includes a fastener receiving opening 43 in the inwardly disposed side of the rod section 30 spaced longitudinally inwardly from the innermost end of the section 31 and longitudinally outwardly of the innermost end of the dowel and a screw fastener 44 removeably engaged through said opening 43 and into and out of engagement with the dowel 40.

The opening 43 is preferably provided with a counter-sink and the fastener 44 is preferably a flat head screw, the head of which is received in the counter-sink.

When the rods are set in their related windows and the fasteners are engaged in the openings 43 and the dowels 40, the rods are effectively locked against longitudinal shifting and against displacement within their related window frames.

The effect release of the locking means L, one must engage the fasteners 44 from the inner side of the guard with a suitable tool and back the fasteners out of engagement in and with the dowel and the section 30.

If desired, a nail fastener can be used in place of the screw fastener, in which case, the means L is permanently set when the nail fastener is driven into the dowel and its head is seated in the counter-sink of the opening 43, where it is rendered unengageable by a nail pulling tool or the like.

The locking means L′ of the guard G′ shown in FIGS. 10 through 13 of the drawings in addition to locking the section 30′ and 31′ of the guard rods in set position in their related frames also serves to mechanically urge the rods to their extended set and anchored positions in the windows.

The means L′ includes an internally threaded block 50 fixed in the free end of its related section 30′. The block 50 can be in the form of a nut and can be fixed in the end of the section 30′ by suitably bent and formed tabs 51 and 52 established from the stock of the section 30′, at the several sides thereof and as clearly illustrated in the drawings.

The means L′ next includes a bearing plate 53 in the outer ends of the sections 31′ and stopped on the bent tabs which establish the stop surfaces 32′ and an elongate threaded drive member 55 engaged through the block 50 and projecting axially outwardly therefrom and through the sections 31′. The outer end of the drive member 55 is provided with a disc shaped head 56 56 in engagement on the plate 53 and having a plurality of circumferentially spaced tool engaging notches 57 about its periphery.

Finally, the means L′ includes upper and lower tool receiving openings 58 and 59 in the inner side of the sections 31′ in close proximity to the plane of the head 56 and through which a tool 60, such as a screw driver can be inserted to engage in the notches 57 (see FIG. 13) and effect rotation of the drive member 55 to effect axial telescoping extension and locking of the sections 30′ and 31′, or to retract the member 55 axially inwardly and thereby permit the sections 30′ and 31′ to be shifted to shorten the axial extent of the rods and permit their disengagement for their related window frames.

The means L′ is such that one must be at the inner side of the guard structure G′, with an appropriate tool to effect operation of the means L′.

Operation of the means L′ from the outside of the guard structure would be most difficult and so time consuming as to discourage a burglar or the like to attempt operation thereof to gain entering through the related window opening.

In practice, the drive member can be established by a standard bolt structure similar to a carriage bolt, the head of which is suitably notched.

With the means A and L or A′ and L′ that I provide, it will be apparent that the sectional rods R and R′ of my guard are axially extensible and adjustable to cooperatively engage in and with window structures of varying inside lateral extent and are such that they can be effectively releasably locked in engagement within the window structure in such a manner that release of the locking means and removal of the guards from the outside of the guards and window structure is not practically possible.

The grate structure X that I provide can vary widely in practice and includes structure establishing a plurality of metal bars extending between the upper and lower rods R and R′ in spaced relationship laterally of the window openings.

The bars can be simple, straight, laterally spaced vertical bars fixed to the sections 30 and 30′ of rod sections as by rivets, spot welding or the like.

In the case illustrated, the grate is established by a pair of interengaged V-shaped metal straps having outwardly recurrent ends 72. The strap 70 has upper outer radiused corners or ends fixed to the lower side of the section 30 of upper rod R and a central lower bend or corner fixed to the top of the section 30 of the lower rod R′. The strap 71 has lower outer radiused corners or ends fixed to the upper side of the section 30 of the lower rod R′ and a central upper bend or corner fixed to the lower side of the section 30 of the upper rod 30.

The inclined leg portion of the straps 70 and 71 cross each other at their centers, at a point midway between the rods and are suitably fixed to each other as by rivets 73, which rivets will permit relative pivoting of the straps.

Figure 9:
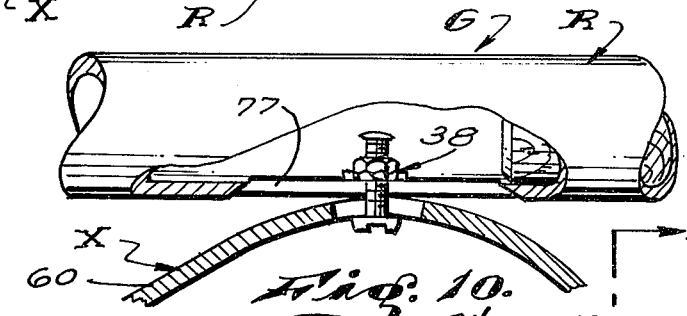
FIG. 9 is a view similar to a portion of the structure illustrated in FIG. 7 and showing another form of the invention.

The several corners of the straps 70 and 71 can, as illustrated, be riveted or otherwise fixed to their relative rods, as shown at 75 in FIGS. 7 and 8 of the drawings or can, as shown in FIG. 9 of the drawings, be releasably shiftably secured to their related rod sections to allow or permit for limited shifting of said corners longitudinally of the rods.

In the form of the invention shown in FIG. 9 of the drawings, the straps are slotted at their corners, as indicated at 76, the rods are slotted as at 77 and a nut and bolt type fastening means 78 is engaged through the slot, as shown. By tightening the fastener means 78, the grate and rod structures can be fixed tightly together. By loosening the means 78 the grate can be shifted axially of the rods in such a manner that the vertical extent of the grate and vertical spacing of the rods can be varied.

The means 78 includes bolts, the heads of which are at the exterior of the rod and the shanks of which extend into the rods and are engaged through nuts within the confines of the rods. The free ends of the shanks are suitably peened over or upset so that the nuts and bolts cannot be disengaged from one another. With such a relationship of parts, even if one were to loosen the fastening means to the extent possible, the grate would still be secured with and between the rods and an intruder could not gain access through the guard and/or window structure related thereto.

With the last noted form of grate structure, it will be apparent that the vertical extent of the guard structure, as well as its lateral extent, can be effectively adjusted to effectively fit in and with window structures of different dimensions.

By adjusting the vertical extent of the guard G, the desired spacing of the top and bottom edges of the guard with the bottom of the sash S and the window sill 12, as previously discussed, can be effectively attained in windows of varying or different extent and without the necessity of producing a special guard for each different size of window structure.

Having described only preferred forms and embodiments of my invention, I do not wish to be limited to the specific details herein set forth, but wish to reserve to myself any modifications and variations that may appear to those skilled in the art and which fall within the scope of the following claims:

I claim:

1. In combination a double hung window structure and guard structure therefor, said window structure including a rectangular frame with laterally spaced vertical side members with inner and outer vertical channels with flat bottoms, a horizontal header and a horizontal sill, an upper outer rectangular sash with sides slidably engaged in the outer channels, a top edge normally engaged with the header and a bottom edge spaced about midway between the header and sill and opposing the sill, a lower inner rectangular sash with sides slidably engaged in the inner channels, a top edge about midway between the header and the sill and opposing the header and a bottom edge normally engaged with the sill, the guard structure comprising vertically spaced horizontal upper and lower rods with upper and lower edges, anchoring means at the ends of the rods engaged with the outer channels, and grating secured to and extending longitudinally of and between the rods, the upper edge of the upper rod and the lower edge of the lower rod being normally spaced from their opposing bottom edge of the upper sash and the sill predetermined limited distances, said upper edge of the upper rod engaging the lower edge of the outer sash upon downward shifting of the outer sash to stop said outer sash with its top edge in predetermined limited vertical spaced relationship from the header, the normal distance between the rods and the sill and the bottom of the outer sash is less than 8 inches and the distance between the header and the top edge of the outer sash is less than 8 inches when said outer sash is shifted down and engaged with the guard whereby the vertical extent of all unobstructed openings in the window and guard structure inhibit the free ingress and egress of a person therethrough, wherein the rods are established of telescopically engaged tubular sections and are axially extensible and include locking means between their related sections to hold the sections against relative axial shifting, whereby the rods are extensible to urge the anchoring means at their ends into engagement in and with their related channels and said rods are locked against axial shifting when said anchoring means are engaged in and with said channels, said anchoring means includes flat stop surfaces at the ends of the rods in flat bearing engagement with the bottoms of their related channels and a plurality of sharp spike projecting longitudinally outwardly from said surface and engaged in the vertical side members, wherein said locking means includes a wood dowel fixed in the inner of said telescopically engaged tubular section of the rods and projecting therefrom in sliding engagement in the outer tubular sections related thereto, openings in the sides of the outer tubular sections and disposed toward the inside of the window structure fasteners engaged in and through said openings and into said dowels.

2. In combination a double hung window structure and guard structure therefor, said window structure including a rectangular frame with laterally spaced vertical side members with inner and outer vertical channels with flat bottoms, a horizontal header and a horizontal sill, an upper outer rectangular sash with sides slidable engaged in the outer channels, a top edge normally engaged with the header and a bottom edge spaced about midway between the header and sill and opposing the sill, a lower inner rectangular sash with sides slidably engaged in the inner channels, a top edge about midway between the header and the sill and opposing the header and a bottom edge normally engaged with the sill, the guard structure comprising vertically spaced horizontal upper and lower rods with upper and lower edges, anchoring means at the ends of the rods engaged with the outer channels, and grating secured to and extending longitudinally of and between the rods, the upper edge of the upper rod and the lower edge of the lower rod being normally spaced from their opposing bottom edge of the upper sash and the sill predetermined limited distances, said upper edge of the upper rod engaging the lower edge of the outer sash upon downward shifting of the outer sash to stop said outer sash with its top edge in predetermined limited vertical spaced relationship from the header, the normal distance between the rods and the sill and the bottom of the outer sash is less than 8 inches and the distance between the header and the top edge of the outer sash is less than 8 inches when said outer sash is shifted down and engaged with the guard whereby the vertical extent of all unobstructed openings in the window and guard structure inhibit the free ingress and egress of a person therethrough, wherein the rods are established of telescopically engaged tubular sections and are axially extensible and include locking means between their related sections to hold the sections against relatively axial shifting, whereby the rods are extensible to urge the anchoring means at their ends into engagement in and with their related channels and said rods are locked against axial shifting when said anchoring means are engaged in and with said channels, said anchoring means includes flat stop surfaces at the ends of the rods in flat bearing engagement with the bottoms of their related channels and a plurality of sharp spike projecting longitudinally outwardly from said surface and engaged in the vertical side members, wherein said locking means includes threaded blocks carried by the inner tubular sections of the rods, bearing plates in the outer tubular sections of the rods, threaded shanks engaged through the blocks and having ends engaging the plates, operating discs on the shanks with circumferentially spaced tool engaging notches within the outer tubular sections and access openings in the sides of the outer tubular sections through which an operating tool is engaged to engage the operating discs.

* * * * *